US005505460A

United States Patent [19]

Wolfenden et al.

[11] Patent Number: 5,505,460

[45] Date of Patent: Apr. 9, 1996

[54] DART WITHOUT REBOUND

[76] Inventors: Dan Wolfenden, 36 Fullerton Avenue, Hamilton, Ontario, Canada, L8L 6G8; Andy Zulps, 129 Parkview Drive, Ancaster, Ontario, Canada, L9G 1Z4

[21] Appl. No.: 302,878

[22] PCT Filed: Apr. 22, 1992

[86] PCT No.: PCT/CA92/00169

§ 371 Date: Sep. 19, 1994

§ 102(e) Date: Sep. 19, 1994

[87] PCT Pub. No.: WO93/21493

PCT Pub. Date: Oct. 28, 1993

[51] Int. Cl.[6] ..... A63B 65/02

[52] U.S. Cl. ..... 273/420

[58] Field of Search ..... 273/416, 419–420, 273/423

[56] References Cited

U.S. PATENT DOCUMENTS

| | | | |
|---|---|---|---|
| 4,109,915 | 8/1978 | Bottelsen | 273/420 |
| 4,230,322 | 10/1980 | Bottelsen | 273/420 |
| 5,009,433 | 4/1991 | Reid | 273/419 |
| 5,118,117 | 6/1992 | Denen | 273/420 |

FOREIGN PATENT DOCUMENTS

| | | | |
|---|---|---|---|
| 1593047 | 7/1981 | United Kingdom | 273/420 |
| 2180461 | 4/1987 | United Kingdom | 273/419 |
| 2196267 | 4/1988 | United Kingdom | 273/416 |

*Primary Examiner*—Paul E. Shapiro

[57] ABSTRACT

A dart (10) of a dart game provides a freely rotatable and reciprocating biased point (11) with a tip (12) that, when the tip (12) hits a wire mesh (W) on a normal dart board or target (T), this causes the point (11) to reciprocatingly collapse or migrate into the dart barrel (18) but due to the forward momentum of the flight of the dart (10) the forward momentum urges the tip (12) off of the wire (W) and causes penetration of the tip (12) into target (T) thereby eliminating, or reducing substantially, incidents of direct hit of the dart tip (12) on the wire (W) whereby the dart (10) would bounce off the dart board or target (T) onto the ground with no points being awarded for the shot. The free rotation of the point allowed, when that point is penetratingly resting in a target, the body of that dart rotates out of the path of travel of an oncoming dart, should the oncoming dart hit the flight or even possibly the barrel of the penetrated dart. The biasing point is always held in its extended or "set" position and the need to reset the point is not necessary.

3 Claims, 1 Drawing Sheet

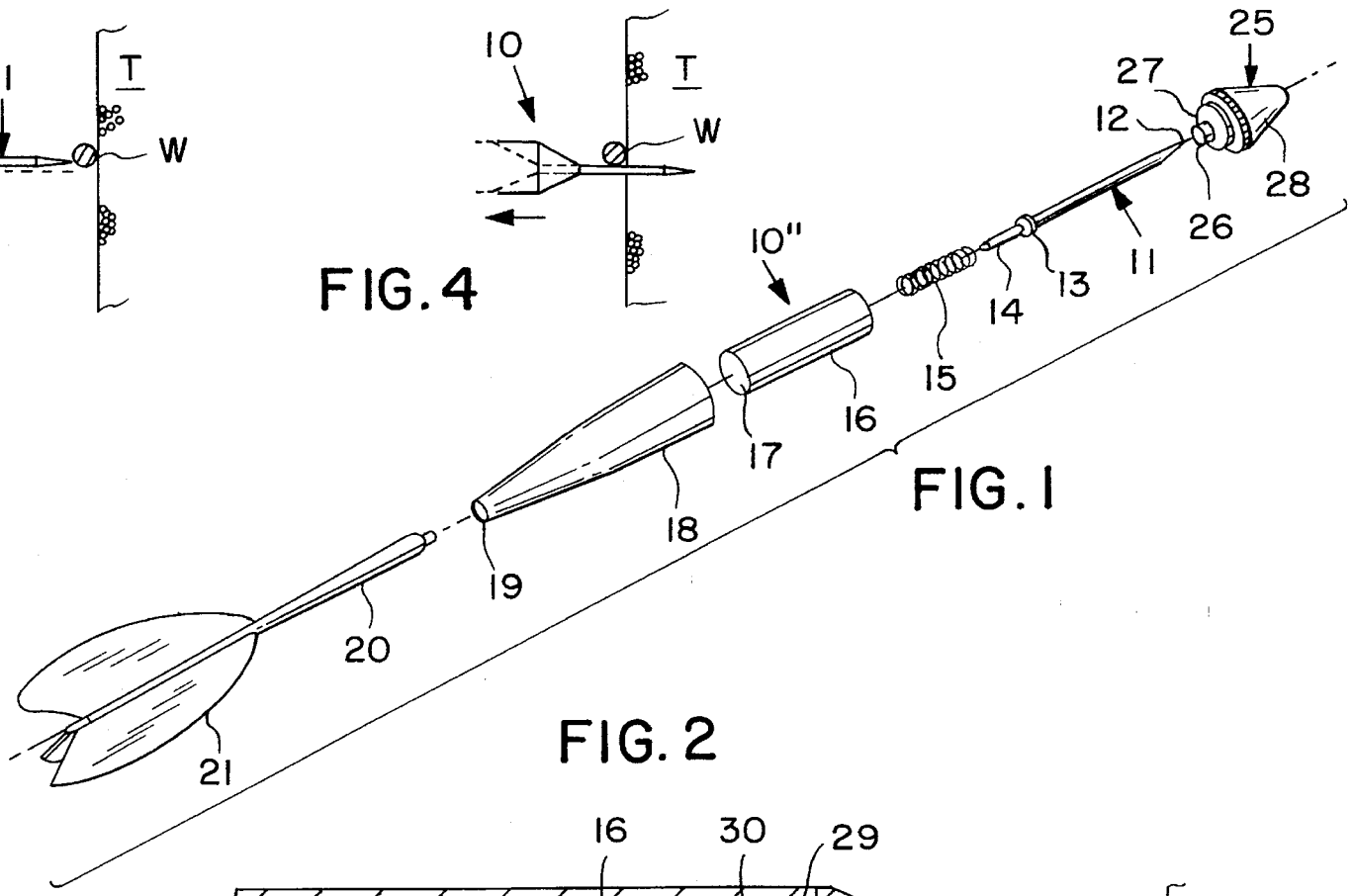
FIG. 1
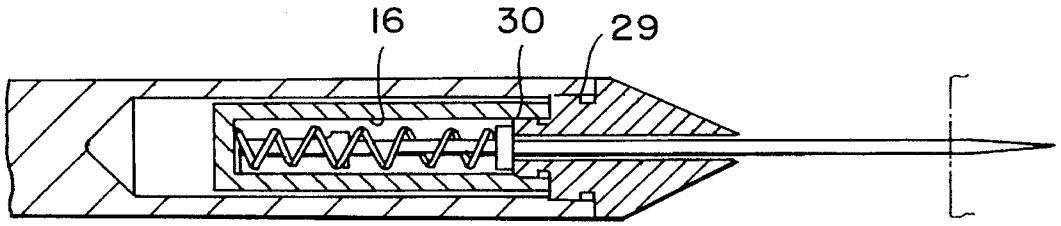
FIG. 2
FIG. 4
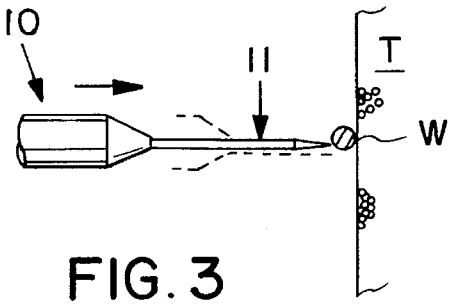
FIG. 3

DART WITHOUT REBOUND

This invention relates to a playing dart in particular, one that has, relative to the dart body or barrel, a biased retractable and freely rotatable point.

BACKGROUND TO THE INVENTION

The skill game of darts is played throughout the world and is competitive when not played as a leisure sport or game. The darts are propelled by the hand toward a disc-like target having a centre bull's eye and circumferential rings, some of which are subdivided into pie-shaped regions, others are chordal. Each of these regions has its own denomination for scoring and each boundary between each region is separated, normally by a shaped round wire, which is organized as a frame work or lattice that overlays the boundaries between each different denominated region to partition the target into physical areas that have unique denominated values. If a dart is thrown toward the boundary of two different denominated regions and it hits the wire which is laid over and runs along the boundary. In many instances the dart bounces off the boundary wire and onto the floor since the point hits the wire head-on. In some instances, where the momentum of the dart is such, or the point strikes the wire other than "head-on" thus near its edge, the point is deflected into the adjacent region, with the point penetrating the region and the dart sticking so as to be awarded points according to the denomination of the region penetrated.

According to the prior art, there is disclosed by one REID in U.S. Pat. No. 5,009,433 issued 22 Apr., 1991 for a "DART FOR AIMING AT A GAMEBOARD". A dart which has a movable point movable along a line with a horizontal longitudinal axis of the body portion of the dart and coincident with the line with the vertical axis of the dart so that the point can stick to the board and avoid obstructions on the board. Such dart has, within a cylindrical bore of the body portion, either a circumferential clasping means which urges against the outside diameter of the dart point, along the margin of the dart point downstream from an approximate furrel end of the dart or alternatively, a plurality or collection of metal balls or shot which move, after impact of the dart point, into a bore downstream absorbing the impact of the dart point within the body. This particular dart has the disadvantage in that the dart point is not automatically re-set to its most outwardly extending position after the dart is retrieved and pulled out of the dart board, because there is no biasing means to urge the dart point to its outward extent.

THE INVENTION

It is an object of the invention to provide the dart with such momentum, that if the point hits the wire head-on, the point will telescope into the barrel of the dart allowing the body of the dart to carry forward by its momentum. The point thus being relieved slightly of its initial impact pressure on the wire but the point tends to glide around the wire and to penetrate into an adjacent scoring region because of the sustained pressure of the dart barrel moving toward the target and holding the point against the wire while biasing the spring inside the barrel. This action encourages the dart point to slide off the wire and to penetrate a target region adjacent thereto rather than for the dart to bounce off the wire onto the floor without penetrating the target.

It is also an object of the invention to provide a rotatable point relative to the body or barrel of the dart so that when that dart penetratingly rests in its dart target, and an oncoming dart strikes the flight of the dart that is penetrated, the body, barrel and flight of the penetrated dart is free to rotate relative to the point so as to move out of the path of the oncoming dart resulting in a better success rate for the oncoming dart in penetrating a target.

It is an additional object of the invention to provide a sub-assembly and a two-tiered collar that allows the barrel to freely rotate around its extending point such that any subsequent dart that makes contact with the dart already in the board, the rotating motion of that dart will allow subsequent flying darts to continue to the desired target by "moving out of the way".

It is a further object of the invention to provide a biasing point so that the point always returns to its original extended position after retraction, and hence, the need to "set" the point is not required.

It is a further object of the invention to provide within the barrel or body of the dart, a replaceable casing, which may be removed from the body of the dart and replaced, in seconds, the said casing containing the biasing means which urges the point into its "set" position.

SUMMARY OF THE INVENTION

The invention therefore contemplates a game dart comprising an elongated barrel having a point coupled thereto, and protruding from the barrel, a shaft, a flight adapted to engage said shaft including means for retaining the same thereon, a barrel housing a sub-assembly, said sub-assembly including a housing having a longitudinal bore, and characterized by the biasing means disposed within the barrel urging against the point whereby the point, on impact as a result of the flying of the dart toward the target provides a sustained momentum of the tip of the point, for a predetermined period of time, against the wire so that the tip migrates off of the wire to penetrate into the target.

BRIEF DESCRIPTION OF THE DRAWINGS

The invention will now be described by way of example and reference to the accompanying drawings in which:

FIG. 1 is an assembly view of the dart according to the invention;

FIG. 2 is a longitudinal section through the body of the dart;

FIGS. 3 and 4 are explanatory elevational views of the dart on impact on the wire and its subsequent continuing penetration into an adjacent denominated score region of the target;

PREFERRED EMBODIMENT

Referring to FIG. 1, the dart is generally indicated as (10) and includes a cylindrical retractable point (11) with pointed tip (12) at one end, and near its opposite end, a furrel (13) mounted near the opposite end (14) of the point (11). A coil spring (15) has one of its ends fitting over the proximate end (14) of the point (11) and urges against the furrel (13). The whole spring (15) with proximate end (14) and furrel (13) of the point (11) fit into a cylindrical casing (16) having its upper end closed and its lower end open allowing the point (11) to protrude therethrough. The same is a sub-assembly and as such, the casing (16) defining a casing or sub-assembly bore fits into a bore (16') defined by body or barrel (18) of the dart (10). At the opposite end of the barrel (18), there is a threaded aperture (19) into which threads shaft (20) having at its opposite end flight (21). The point (11) is constrained within the barrel (18) by a collar (25) which has a cylindrical channel (26) therethrough through which the point (11) extends. The point (11) is adapted to reciprocatingly travel through the collar (25) and to rotate relative to the collar (25) and the body or barrel (18) so that when this dart is penetratingly fixed into a target, and an oncoming dart strikes the penetrated dart flight, the flight of the penetrated dart body and barrel are free to rotate relative to the tip of the penetrated dart and thereby move out of the road or pass the flight of the oncoming dart. The collar (25), preferably, has a threaded cylindrical protrusion which screws into corresponding threads (29) at the downstream end of the barrel (18) and also into the downstream end of the casing (16) by engaging threads (30) formed on the inner surface of the downstream and of the casing (16). In that respect, the collar (25) has a stepped threaded portion (29,30) with an exterior outer profile (28) resembling a truncated conic. Threads are preferred for the collar (25), barrel and casing so that the spring (15) may be replaced when it becomes weak. The spring, which places a bias on the tip, forces the tip into full extension at all times, save on impact, as hereinafter will be explained.

After assembly and with reference to FIG. 2, the same illustrates the arrow assembled.

When thrown toward a target (T), if the tip (12) should, and now referring to FIG. 3, hit a wire which overlays the boundary of two different denominated scorable regions, the point (11) telescopes into the barrel (18) causing the furrel (13) to push against the coiled spring (15), into the phantom position shown in FIG. 2. In the meantime, and referring to FIG. 3, the dart (10) progresses in the direction of the arrow with the barrel (18) moving into the phantom position of that figure to apply a constant pressure on the point (11) and the tip (12) on the wire (W), causing the tip (12) to migrate off the wire (W), as shown in phantom, and to penetrate the target region adjacent the wire. This action is assured because during the forward movement of the barrel (18), which occurs because of the dart (10) momentum during flight, there will be a small, yet unbalanced distribution of forces by the point (11) on the wire (W) which will cause the dart tip (12) to migrate off the wire (W), as described.

FIG. 4 illustrates the momentum after impact and subsequent penetration into adjacent scoring region of the target (T) where the body of the dart (10) moves, in the direction of the arrow, as a result of the continuing biasing force of the coiled spring (15) on the closed end (17) of the casing (16), on the one hand, and on the furrel (13) of the point (11) on the other.

We claim:

1. A game dart (10) comprising;

(a) a barrel (18) defining an internal bore (16') that communicates with one end of the barrel, the barrel carrying at its opposite end, means for carrying a shaft (20) and a flight (21);

(b) a point (11) with pointed tip (12) at one end and near its opposite end (14) a furrel (13);

(c) a removable sub-assembly (16) adapted to removingly fit into the internal bore (16'), the sub-assembly (16) defining a sub-assembly bore (16");

(d) a biasing means (15) located within the sub-assembly bore (16') biasing against the furrel (13);

(e) a removable collar (25) defining an aperture (26) through which the point (11) is adapted to reciprocatingly travel said collar (25), sub-assembly (16) and body (18) having means by which the collar can fittingly attach to both sub-assembly (16) and body (18) whereby completing an assembled dart, the point (11) of which is sized to travel, in part, in a sliding fashion, within the sub-assembly (16) and aperture (26) characterized in that the biasing means (15) is a continual biasing means constantly urged against the furrel (13) to urge the point (11) into its fully extended position, but on impact of the point (11), as a result of the flying of the dart toward a target (T), carrying wires (W), the barrel (18) provides a substantial momentum of the dart (10) to the point (11), for a pre-determined time , against the wire (W) so that the tip (12) of the point (11) migrates off the wire (W) to penetrate into the target (T), and immediately thereafter, to re-set the point (11) to its most outwardly extended position after impact.

2. The dart (10) as claimed in claim 1, characterized in that the collar (25) has means (29) adapted to fittingly engage into the barrel (18) and cylindrical casing (16), and defines an aperture (26) therethrough, through which the point (11) extends.

3. The dart (10) as claimed in claim 1 or 2, wherein the continual biasing means (15) is characterized by a coil spring (15).

* * * * *